United States Patent [19]

Holman et al.

[11] 4,011,072

[45] Mar. 8, 1977

[54] FLOTATION OF OXIDIZED COPPER ORES

[75] Inventors: James B. Holman; John A. Cronin, both of Inspiration, Ariz.; Bernhard Lamby, Moers, Germany

[73] Assignee: Inspiration Consolidated Copper Company, Inspiration, Ariz.

[22] Filed: May 27, 1975

[21] Appl. No.: 581,267

[52] U.S. Cl. ..... 75/2; 209/166; 423/26

[51] Int. Cl.[2] ..... B03D 1/08; C22B 15/00

[58] Field of Search ..... 75/2, 108, 117; 423/34, 423/37, 42, 43, 26; 209/166

[56] References Cited

UNITED STATES PATENTS

| | | | |
|---|---|---|---|
| 3,421,850 | 1/1969 | Peterson | 423/43 |
| 3,582,317 | 6/1971 | Gamo | 75/117 |
| 3,667,690 | 11/1969 | Weston | 209/166 |
| 3,735,931 | 5/1973 | Weston | 209/166 |
| 3,883,421 | 5/1975 | Cutting | 75/2 |

*Primary Examiner*—L. Dewayne Rutledge
*Assistant Examiner*—Michael L. Lewis

[57] ABSTRACT

Copper is recovered from an aqueous pulp of an ore containing both sulfide minerals and oxidized minerals by continuously monitoring the EMF of the pulp and adding a water-soluble sulfide to the pulp in an amount from 0.05 to 7 pounds of contained sulfur per ton of ore whenever and for so long as the pump EMF is above about −30 millivolts with reference to a standard silver-silver chloride electrode, and discontinuing such addition whenever such EMF in less than about −30 millivolts. Thereafter the pulp is subjected to a froth flotation operation in the presence of a collector for copper sulfide minerals to produce a concentrate containing most of the sulfide minerals and a substantial part of the oxidized minerals of the ore.

4 Claims, No Drawings

FLOTATION OF OXIDIZED COPPER ORES

BACKGROUND OF THE INVENTION

Many copper deposits contain both sulfide and oxidized copper minerals in close association. For example, many deposits of copper sulfide minerals which occur near the ground surface are partially converted by weathering effects to mixed sulfide-oxidized ore. Also, many orebodies which were opened and originally mined as sulfide ores have over the years become partially oxidized. The sulfide minerals of such ores are readily concentrated by froth flotation, but the oxidized minerals are more difficult to concentrate.

It has been proposed many times to treat the oxidized minerals with a reactive sulfide, to convert them at least superficially to sulfide form, so that they too may be concentrated by froth flotation along with the sulfide minerals. Such proposals have met with some success, but the recovery of oxidized copper minerals by this technique has been poor. Whereas it is generally possible to recover in the flotation concentrate 70% to 90% or even more of the sulfide copper content of a mixed ore, the recovery of oxidized copper minerals is ordinarily much poorer, generally less than 50% and often less than 25%.

NATURE AND STATEMENT OF THE INVENTION

It has now been found that the recovery of oxidized copper minerals from mixed ores by flotation along with the sulfide minerals may be significantly increased by adding a soluble sulfidizing agent to a pulp of the ore and controlling such addition in accordance with the EMF of such pulp.

In accordance with the invention, copper is recovered from an aqueous pulp of an ore containing both oxidized and sulfide copper minerals by continuously monitoring the EMF of the pulp, and adding a water-soluble sulfide to the pulp in an amount from 0.05 to 7 pounds of containd sulfur per ton of ore whenever and for so long as the pulp EMF is above about −30 millivolts with reference to a standard silver-silver chloride electrode and discontinuing the addition of such sulfide to the pulp whenever and for so long as such EMF value becomes less than about −30 millivolts, and thereafter subjecting the pulp to a froth flotation operation in the presence of a collector for copper sulfide minerals, thereby producing a concentrate containing most of the sulfide minerals and a substantial part of the oxidized minerals of the ore. The precise value of pulp EMF below which sulfide is added will vary with the particular ore being concentrated, but will be in the neighborhood of −30 millivolts, and can readily be determined by a few trial flotation operations.

As a preliminary step, the ore pulp may if desired be subjected to a conventional flotation operation in the presence of a sulfide mineral collector, without any addition of soluble sulfide, to recover a large part of the sulfide minerals in a first concentrate. Then the residual pulp may be treated as described above to form as second concentrate containing additional sulfide minerals plus oxidized minerals. These two concentrates may if desired be combined for further treatment, as by a cleaner concentration operation.

Preferably the pH of the pulp at the time of addition of the soluble sulfide is in the range from 8 to 11. Such addition may be made during conditioning of the pulp with lime and with the collector. Preferred sulfidizing agents are sodium hydrosulfide (NaHS), sodium sulfide ($Na_2S$), hydrogen sulfide ($H_2S$) and ammonium sulfide ($(NH_4)_2S$). When using sodium hydrosulfide, which is especially preferred for reasons of economy and ease of handling, it may be added to the pulp in amounts from 0.1 to 10 pounds per ton of ore whenever the pulp EMF is above about −30 millivolts relative to a standard silver-silver chloride electrode.

DESCRIPTION OF THE INVENTION

The invention may be used in the flotation concentration of any partially oxidized sulfide copper ore. The preparation of such ore for flotation concentration is essentially conventional. That is to say, the ore is crushed and ground in an aqueous medium to reduce the particle size sufficiently for effective liberation of minerals from gangue (typically 50% minus 200 mesh).

It is sometimes advantageous, but not essential, to subject the pulp of ground to a first conditioning and flotation operation which is essentially conventional. The preparation of such ore for flotation concentration is essentially conventional. That is to say, the ore is crushed and ground in an aqueous medium to reduce the particle size sufficiently for effective liberation of minerals from gangue (typically 50% minus 200 mesh).

It is sometimes advantageous, but not essential, to subject the pulp of ground ore to a first conditioning and flotation operation which is essentially conventional, to form a first concentrate containing mainly sulfide minerals of the ore. In such conventional conditioning and flotation operation the usual additions are made to the pulp, such as lime and other conditioning agents, a sulfide mineral collector, and a frother. The collector may include one or more reagents that promote flotation of oxidized minerals; but the concentrate collected in the first flotation operation will mainly contain sulfide copper minerals and only a relatively small proportion, if any, or oxidized copper minerals. Such preliminary conventional sulfide mineral flotation may in some cases improve the overall sulfide mineral recovery.

The residual (tailing) pulp from such conventional flotation operation, if any, or the original pulp of ground ore, is introduced into conventional flotation conditioner cells, and there may be thoroughly mixed with lime (if the ore requires it) in amount to adjust the pH to the desired value (generally from 8 to 11 and most often from 9 to 10); and it is also mixed with the desired flotation reagents. Typically a xanthate (e.g. potassium ethyl xanthate or amyl xanthate) may be added as the collector, and pine oil or a suitable carbinol may be added as the frother. During this conditioning operation the EMF of the pulp is continuously monitored. To this end the voltage between a platinium electrode in contact with the pulp and a standard silver-silver chloride electrode connected by a salt bridge to the pulp is continously measured. Such measurement may be made on an indicating or recording millivoltmeter, or preferably on both. Whenever such instrument shows a voltage higher (i.e. less negative) than about −30 millivolts, a soluble sulfide is introduced into the pulp in amount from 0.05 to 7 pounds of sulfur contained in such sulfide per ton of ore solids in the pulp. Such addition is continued until the pulp EMF falls below about −30 (e.g. to a numerically higher negative value) whereupon the addition of soluble sulfide is discontinued.

As noted above, the EMF value below which the sulfide is added to the pulp cannot be expected to be exactly −30 millivolts for all ores, although it will in most cases be not far from −30 millivolts. For that reason the cut-off EMF value is herein stated to be about −30 millivolts. The precise optimum EMF cut-off value for any particular ore can readily be ascertained by a few trial flotation operations beginning at several different EMF values in the vicinity of −30 millivolts, and from the flotation results of such trial operation selecting the EMF cut-off value that gives most satisfactory results.

In the ordinary commercial operation, conditioning is carried out as a continuous operation, with pulp flowing continuously through the conditioning cell at a rate such that the retention time of the pulp in the cell conforms to the desired conditioning time. Preferably in such operation the millivoltmeter by which the pulp EMF is monitored is connected in an electrical control circuit through which a solenoid valve regulating the inflow of soluble sulfide into the pulp is activated. With such a control system the introduction of soluble sulfide is automatically and continuously regulated to establish the correct amount of soluble sulfide in the pulp.

Any sulfide which is soluble in the pulp (i.e. is water-soluble) may be used, such for example as an alkali metal sulfide (sodium sulfide, $Na_2S$, or soldium polysulfide, or sodium hydrosulfide, NaHS), or ammonium sulfide or polysulfide, or hydrogen sulfide. For ease and convenience in adding the sulfide to the pulp, it is preferably dissolved in water and the resulting sulfide solution is flowed into the pulp at a rate sufficient to add the amount required to maintain the pulp EMF at or near −30 millivolts relative to the standard electrode. Sodium hydrosulfide is the preferred sulfide, both for reasons of economy and for convenience in supplying it in aqueous solution of predetermined sulfur content.

The conditioned pulp to which the soluble sulfide has been added, and containing the desired flotation reagents, is then subjected to a conventional flotation operation to produce a concentrate in which sulfide minerals originally present in the pulp are recovered together with minerals which were originally present in the pulp in oxidized form. The treatment of the pulp with the soluble sulfide converts such oxidized minerals to sulfides, or at least forms on the surface of the oxidized mineral particles a sulfide film by which the collector is able to insure their successful flotation. By virtue of the EMF monitoring and control of sulfide addition, the proportion of oxidized copper minerals collected in the concentrate is substantially increased as compared with other procedures heretofor used to regulate sulfide addition to the pulp. For example, oxidized mineral recoveries in the concentrate in the range from 50% to 75% may in many cases be obtained, whereas recoveries below 50% (and often much below 40%) are generally obtained by sulfide additions without the EMF control which characterizes this invention.

The conditioning of the pulp and flotation of the copper minerals may if desired be carried out in a series of several successive operations. For example, after a first conditioning and flotation operation, the pulp from which the concentrate has been separated may again be conditioned, with or without a further lime addition and further additions of flotation reagents, but with further EMF monitoring of the pulp. In this second conditioning operation, a further amount of soluble sulfide is added whenever the pulp EMF measured relative to a standard silver-silver chloride electrode rises above about −30 millivolts, and is discontinued whenever it falls below this valve. The pulp after this further conditioning is again subjected to a flotation operation to separate a concentrate of copper sulfide minerals, in which is contained a further quality of minerals which originally were in oxidized form. Further repetition of the conditioning and flotation operation may be carried out if desired. Generally two or more such conditioning and flotation steps are desirable if the amount of oxidized minerals in the ore is substantial.

Preferably (but not necessarily) the initial flotation operations performed on the EMF-monitored conditioned and sulfide-treated pulp are conducted as rougher flotation operations, to make a maximum recovery of copper from the ore without seeking to produce a concentrate of high grade. The concentrates from all such operations then are combined and retreated in one or more cleaner flotation operations to produce a final concentrate of desired high grade. If a preliminary flotation of sulfide minerals, without soluble sulfide addition, has been performed, the concentrate from that operation may also be combined with the feed to the cleaner. The tailing from the cleaner operation is as usual returned for retreatment in one of the rougher flotation operations (preferably the first if the ore pulp has been treated in a succession of such operation). The tailing from the final rougher flotation goes to waste.

EXAMPLES OF THE INVENTION

EXAMPLE I

A mixed ore containing 0.9% by weight copper in the form of sulfide minerals and 0.24% by weight copper in the form of oxidized minerals was ground in a rod mill to 50% −200 mesh in an aqueous pulp containing about one pound of lime per ton of ore. The pulp of ground ore, at a pulp density of 33% by weight solids, was conditioned for 1 minute with lime in amount sufficient to bring the pH to a value between 8.5 and 10.5, and with an amyl xanthate collector and a frother comprising methyl isobutyl carbinol. No soluble sulfide was added during this operation. At its conclusion the pulp was subjected to flotation for 5 minutes, whereby about 60% to 70% of the sulfide copper minerals were collected in a first concentrate.

The residual pulp was then subjected for one-half minute to a further conditioning operation, during which the EMF of the pulp was monitored relative to a standard silver-silver chloride electrode, and sodium hydrosulfide was added so long as the EMF reading was above −30 millivolts. The amount of NaHS added was 0.24 pound per ton of ore solids. Lime to maintain the pH in the 8.5 to 10.5 range, and additional amyl xanthate collector in the amount of 0.12 pounds per ton of ore solids, also were added during this conditioning operation. After this further conditioning operation the pulp was subjected to a second flotation operation for three minutes, and a second concentrate was collected containing more of the remaining sulfide copper minerals and about 50% of the oxidized copper minerals.

The ore pulp from the second flotation operation, now containing about 30% by weight solids, was subjected to a third conditioning operation with continued monitoring of its EMF which had risen to above −30 millivolts. During this third conditioning operation (lasting one-half minute) 0.12 pound NaHS per ton of ore solids was added to reduce the pulp EMF to −30 millivolts, and additional amyl xanthate collector amounting to 0.06 pound per ton of ore solids was added. Then the pulp was subjected to a third flotation operation for a period of two minutes, resulting in the collection of a third concentrate comprising some sulfide minerals and additional oxidized minerals.

The three concentrates were combined as rougher concentrates and subjected to a cleaner flotation operation to produce a high grade concentrate for smelting. Tailings from the third rougher concentration operation were discarded. These tailings contained 0.02% sulfide copper minerals and 0.08% oxidized copper minerals; so that the overall recovery of copper in the rougher concentrate was 91.5% of the copper content of the ore, made up of 97.9% by weight of the sulfide minerals and 67.9% by weight of the oxidized minerals of the ore.

EXAMPLE II

An ore containing 0.33% by weight sulfide copper minerals and 0.45% by weight oxidized copper minerals was subjected to a sequence of conditioning and rougher flotation operation as described in Example I. The final rougher tailings contained 0.09% sulfide copper minerals and 0.17% oxidized copper minerals, for an overall recovery in the concentrate of 73.2% of the sulfide minerals and 62.9% of the oxidized minerals.

We claim:

1. The method of recovering copper by froth flotation from an aqueous pulp of an ore containing both sulfide and oxidized minerals of copper which comprises subjecting an aqueous pulp of the ore to a first froth flotation operation in the presence of a collector for sulfide copper minerals, thereby producing a concentrate containing a large proportion of the sulfide copper minerals, then subjecting the residual ore pulp to a further operation which comprises continuously monitoring the EMF of the pulp, adding a water-soluble sulfide to the pulp in an amount from 0.05 to 7 pounds contained sulfur per ton of ore whenever and for so long as the pulp EMF rises above about −30 millivolts with reference to a silver-silver chloride standard electrode and discontinuing such addition whenever such EMF becomes less than about −30 millivolts, and thereafter subjecting the pulp to a second froth flotation operation in the presence of a collector for copper sulfide minerals, thereby producing a concentrate containing much of the remaining sulfide copper minerals and a substantial part of the oxidized copper minerals of the ore.

2. The method according to claim 1 wherein the pH of the pulp at the time of addition of the soluble sulfide is in the range from 8 to 11.

3. The method according to claim 1 wherein the water-soluble sulfide is selected from the group consisting of sodium hydrosulfide (NaHS), sodium sulfide ($Na_2S$), hydrogen sulfide ($H_2S$), and ammonium sulfide ($(NH_4)_2S$).

4. The method according to claim 3 wherein the soluble sulfide is sodium hydrosulfide and the amount added to the ore pulp is from 0.1 to 10 pounds per ton of ore.

* * * * *